US005979877A

United States Patent [19]

Argüelles

[11] Patent Number: 5,979,877

[45] Date of Patent: Nov. 9, 1999

[54] JACK FOR VEHICLE

[75] Inventor: Joseba Palacios Argüelles, Santurtzi, Spain

[73] Assignee: Batz, S. Coop, Igorre, Spain

[21] Appl. No.: 09/019,047

[22] Filed: Feb. 5, 1998

Related U.S. Application Data

[62] Division of application No. 08/785,770, Jan. 21, 1997, Pat. No. 5,782,457.

[30] Foreign Application Priority Data

Jan. 22, 1996 [ES] Spain ..... 9600128
Feb. 1, 1996 [ES] Spain ..... 9600231

[51] Int. Cl.[6] ..... B66F 3/12

[52] U.S. Cl. ..... 254/126

[58] Field of Search ..... 259/126, 122, 259/129, 133, DIG. 4, DIG. 1

[56] References Cited

U.S. PATENT DOCUMENTS 4,194,725 3/1980 Erschens .
5,011,118 4/1991 Brosius .
5,184,806 2/1993 Erschens et al. .
5,460,352 10/1995 Calafi .
5,516,066 5/1996 Fabiano et al. .
5,529,286 6/1996 Kikuchi .

FOREIGN PATENT DOCUMENTS 2 145 392 3/1985 United Kingdom .

*Primary Examiner*—Robert C. Watson
*Attorney, Agent, or Firm*—Browdy and Neimark

[57] ABSTRACT

A vehicle jack that provides a rotation shaft (4) for the support plate (3) on the vehicle support arm (2) and a nut to be received in the end of the jack support leg (1), through which the screw-threaded spindle shaft passes. The rotation shaft (4) rests on and passes through sets of holes in the vehicle support arm (2) and the support plate has downwardly projecting side fins (6), through which the said shaft also passes. The nut (12) determines a set of diametrically opposed projections (22) with an irregular outer surface, through which it is fixed to the holes (16, 18) cut in the side end wings of the vehicle support arm.

1 Claim, 4 Drawing Sheets

JACK FOR VEHICLE

This is a division of copending parent application Ser. No. 08/785,770, filed Jan. 21, 1997 now U.S. Pat. No. 5,782,451.

This invention relates to a vehicle jack of the type that are made up of a jack support leg provided with a support foot and by a vehicle support arm that pivots or turns on the jack support leg. The vehicle support arm has a free end with a support plate that receives the edge of the vehicle bodywork and receives support between the wings of the U-shaped section with which it is provided, into which the end of a screw-threaded spindle shaft is fitted, which, at its other end, is connected to a spindle shaft nut housed in the jack support leg.

The screw-threaded spindle shaft has an end with a winding handle whose action causes the spindle shaft to turn, thus producing the mutual pivoting of the jack support leg and vehicle support arm, and raising the vehicle support arm with the corresponding support plate.

A jack of this type is known through Spanish User Model No. 247,051, which provides a support plate situated on a rotation shaft parallel to the pivoting shaft of the vehicle support arm and the jack support leg, with both being essentially horizontal. The rotation shaft is supported directly on the lower face of the support plate, which is provided with a set of downward lobes in which the said plate is received. The lobes extend between the interior of the wings of the U-shape of the vehicle support arm and the rotation shaft is welded to the arm on which it is situated.

This constructional solution presents the disadvantages that problems might arise from the possible detachment of the welding and, moreover, the fact that the welding operations themselves make the jack more expensive to produce.

On the other hand, on known jacks and as regards the nut on the spindle shaft, there are jacks in which the said nut is housed in the jack support leg by means of closed holes in the wings or sides of the leg, in such a way that the leg is strengthened. In these cases, with closed holes, it is common to resort to folding or bending of lugs or areas of the wings on the jack support legs themselves, once the nut has been housed, which means the disadvantage of having to carry out additional mechanical operations.

As opposed to these known techniques, the invention provides the following fundamental objectives:

- a rotation shaft arranged between the wings of the vehicle support arm, that avoids any welding operation and thus prevents the possibility of the shaft becoming detached, a support plate-rotation shaft assembly that can be carried out at a lower cost. a nut on the spindle shaft and a special formation at the end of the jack support leg that reinforce the leg and allow manual assembly of the nut with the spindle shaft, winding handle, etc., which can be totally assembled in advance and without the need for other operations,
- physical elimination of the rotation shaft, which is replaced by a particular fitting together between the wings from which the vehicle support arm and the support plate itself are made up, with a very low cost.

To put into operation the objects of the invention, the end of the vehicle support arm is drilled, so that two opposing holes are provided in the wings of the U-shaped section of which the said vehicle support arm is composed. The rotation shaft of the support plate is housed in these two holes, through which it projects towards the interior.

For its part, the support plate is provided with a set of side fins which also each have holes drilled in them. These fins are arranged in vertical planes arranged perpendicularly in relation to the direction of the rotation shaft and the holes in the said fins are aligned, so that they can receive the projecting ends of the said shaft.

For the respective securing of the rotation shaft and the support plate, the projecting ends of the shaft are riveted onto the vertical fins, with which the said fixing is carried out.

As a variant of the assembly solution described in the previous paragraph, the two vertical fins have sets of lugs, which, once the shaft has been positioned by connecting the wings on the vehicle support arm and the fins, are bent or folded over the front parts of the projecting ends of the shaft, thus controlling lateral movements.

As regards the nut on the spindle shaft and its insertion and consequent assembly on the jack support leg, the free end of the support leg has the ends of its wings closed to the exterior and a portion without a base, in which a lower gap or opening is created between the wings that is greater than the average distance between the said wings. This gap or opening also reaches the positions of the wings in which the holes for housing the nut are carried out, in such a way that these adopt an almost circular shape with an uneven elevation, as will be made clear later in connection with the accompanying drawings.

The nut is housed in the jack support leg by taking advantage of the said gap or opening and, thanks to its special geometry, it adapts perfectly to the said holes. This nut on the spindle shaft has on its exterior two diametrically opposed projections of a cylindrical shape and circular base plan. Each one of these projections is provided on the exterior with a fin that protrudes out in relation to the outer plane of these projections in a radial position. The projections determine a set of recesses or hollows below themselves.

On housing the nut in the jack support leg through the aforesaid entrance or intake, the projections on the nut fit perfectly to the geometry of the uneven holes in the vehicle support arm. The half cylindrical portion of the projections is received in the part of the holes that remain at the average width of the jack support leg, and the half portion provided with the protruding fin in the part of the holes that corresponds to the previously mentioned lower widening, with which the securing of the nut to the jack support leg is carried out.

Optionally, and in order to facilitate the fit with greater security if possible, the cylindrical portion of the projections is provided with a skirt that protrudes out in a diametrical position in relation to the position of the fins. In the assembly, this skirt remains outside the wings of the jack support leg, as will be observed by reference to the corresponding figures.

As regards the final object of the invention, it is pointed out that the exterior of the ends of the wings of the vehicle support arm are carried out with some projections of a circular shape covering a certain angle, that provide a sliding surface.

For its part, the support plate, metallic in this case, is provided with some side projections finishing in vertical lugs. The side projections are made in the plate with the same distance between each other as the distance that exists between the aforesaid projections on the vehicle support arm.

In turn, these projections correspond, i.e. they allow both pairs of them, those on the plate and those on the vehicle support arm, to have the same characteristics as regards curvature, surface dimensions, opening angle, etc. in such a way that the support plate can be superimposed onto a vehicle support arm and the plate can slide the corresponding angle on the arm.

Once the vehicle support plate has been received, it is possible to proceed with bending the ends of its lugs below the support surfaces of the jack support legs, in such a way that the plate is secured in its transversal movements in relation to the jack support leg and capable of turning in relation to it.

In this way, the rotation shaft is materially eliminated, which is replaced by the corresponding assembly of the plate on the support arm.

In the sheets of drawings that accompany this report, the following details of the invention are shown, with a non-restrictive nature:

Figure 3:
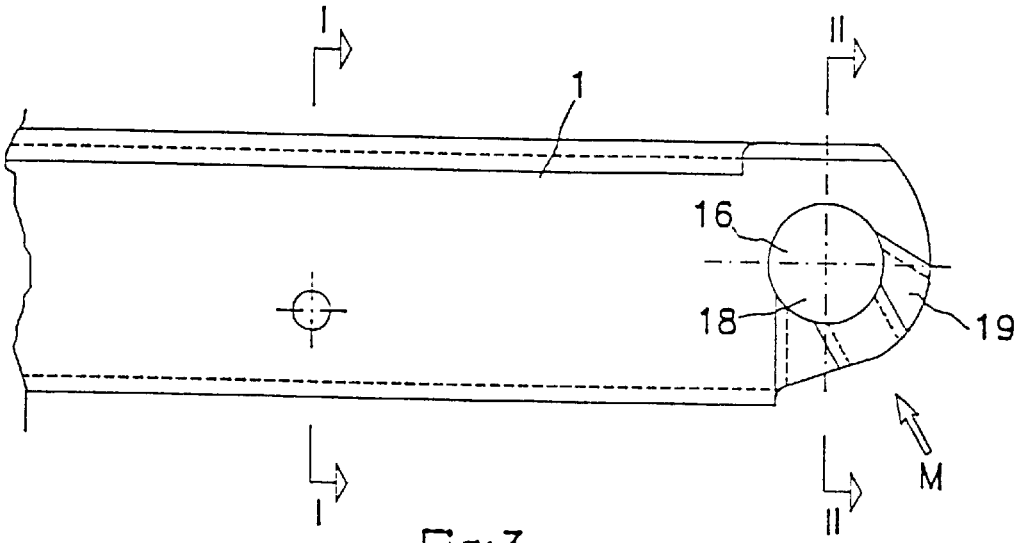
FIGS. 3 and 6 are two views of the end of the jack support leg in accordance with the invention, which is not represented in FIG. 1.
Figure 4:
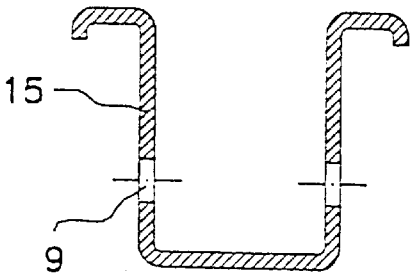

FIG. 4 corresponds to the cross-section I—I shown in FIG. 3.

Figure 5:
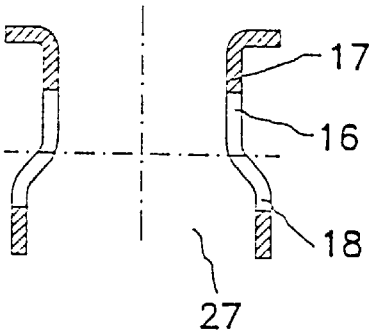

FIG. 5 is the result of the cross-section II—II shown in FIG. 3.

Figure 7:
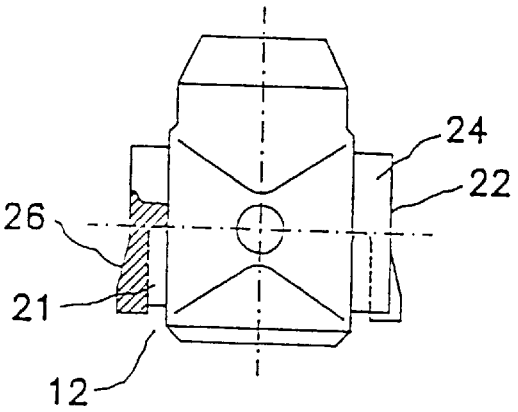

FIG. 7 is the view of the elevation of the nut on the spindle shaft in accordance with the invention.

Figure 8:
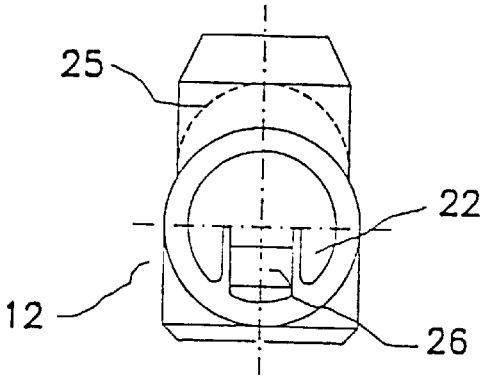

FIG. 8 is a view from the left of FIG. 7.

Figure 9:
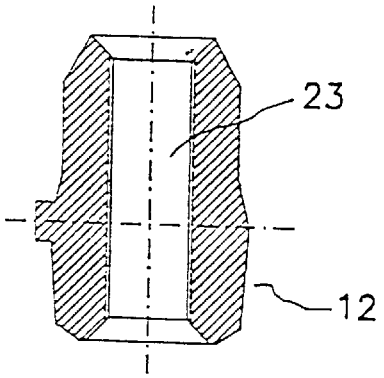

FIG. 9 is a view of the longitudinal section of the nut.

Figure 10:
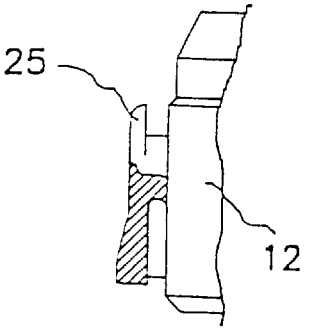

FIG. 10 is an optional detail of the projections on the nut.

Figure 11:
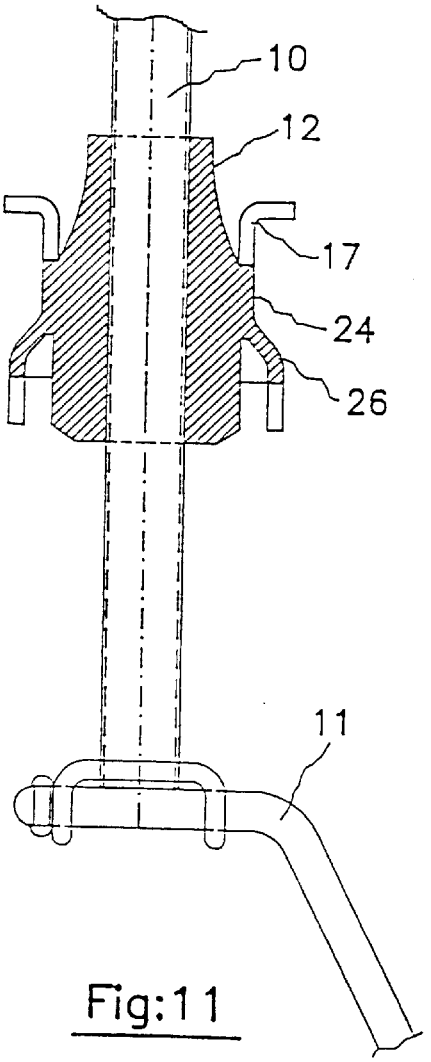

FIG. 11 represents the nut, in accordance with the invention, assembled on the end of the jack support leg.

Figure 12:
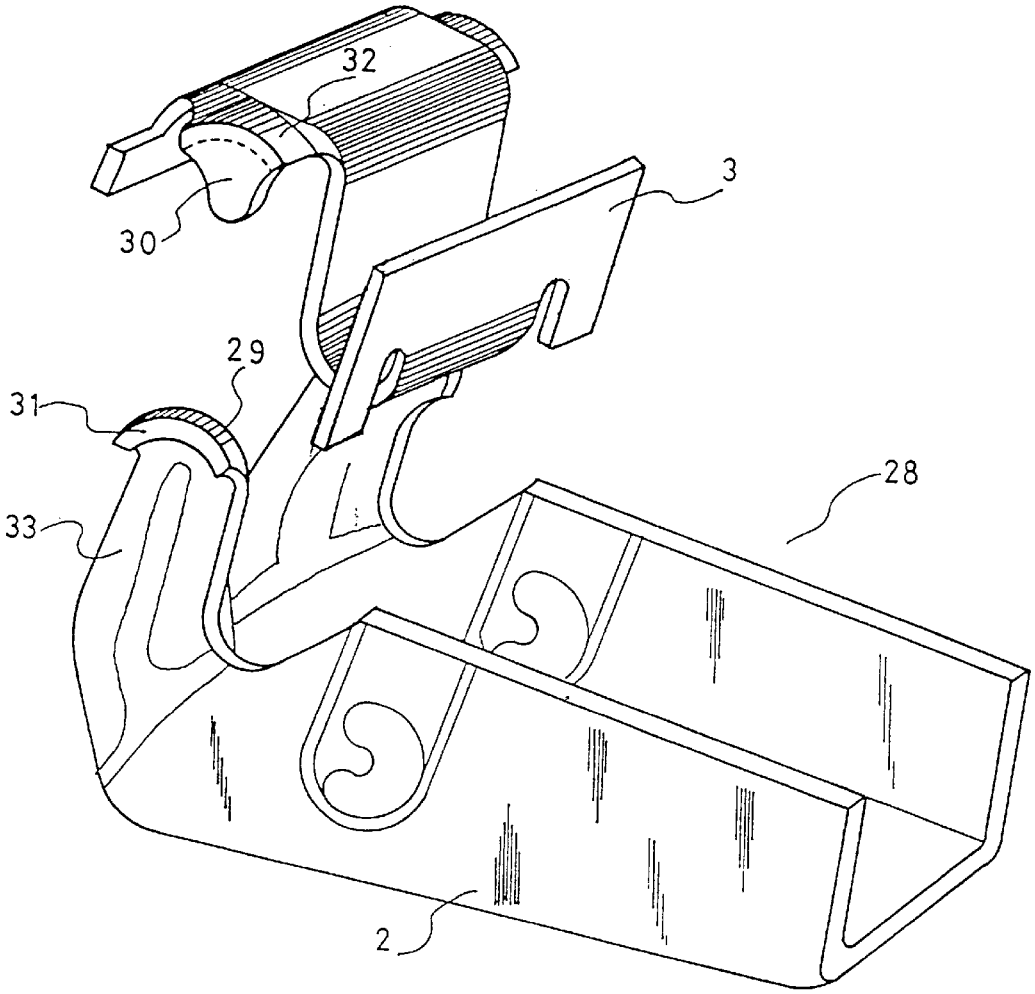

FIG. 12 is a perspective of the free end of the vehicle support arm showing the object of the invention.

Figure 13:
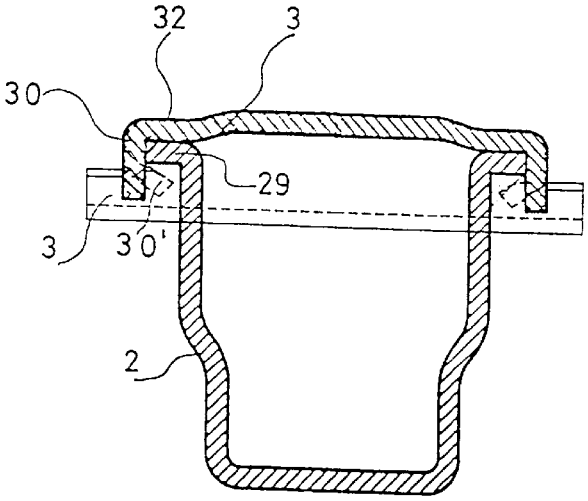

FIG. 13 is a mid-view of the vertical section of the assembly of the plate on the arm.

Figure 1:
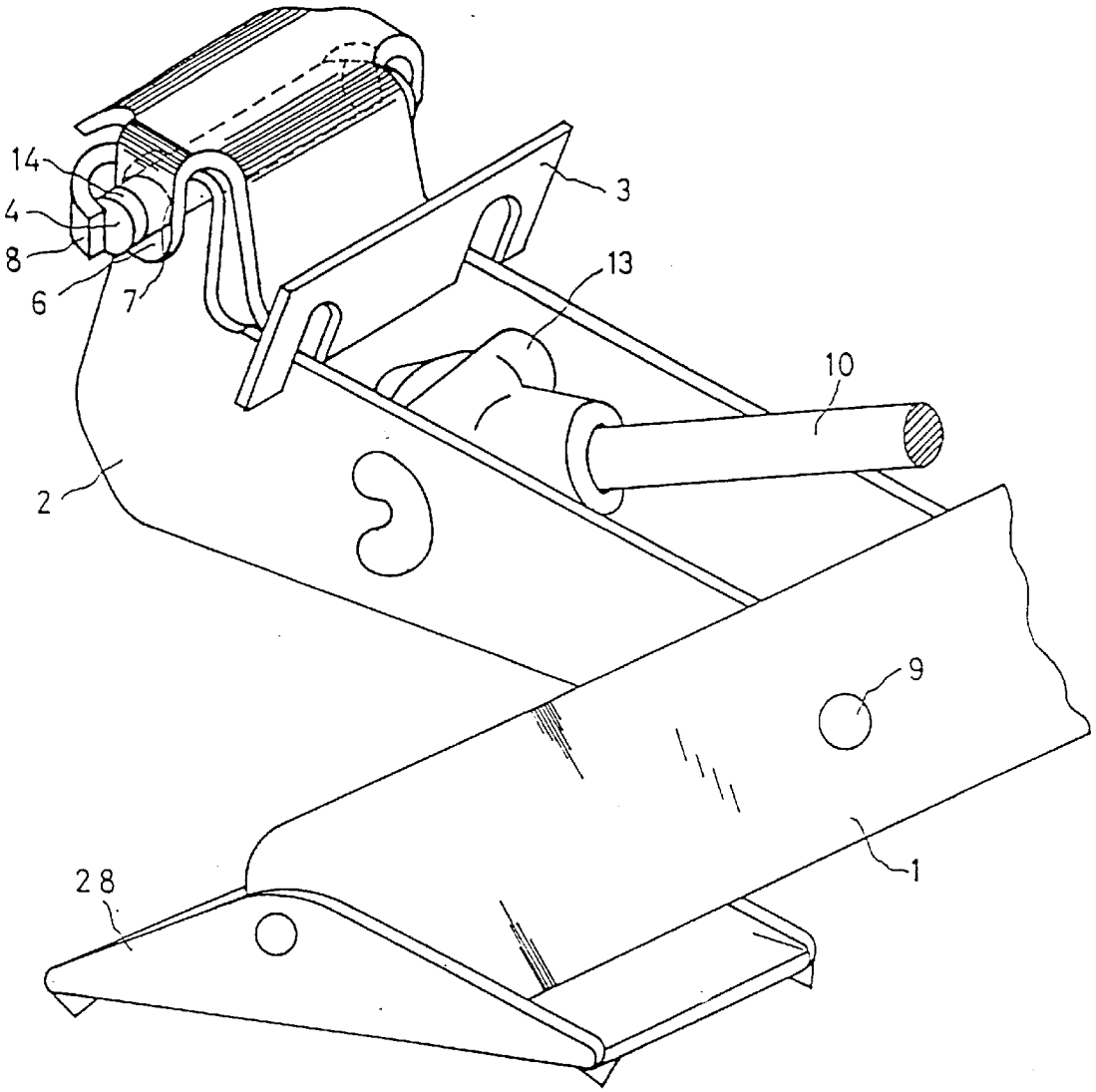
FIG. 1 shows a partial view of a jack that incorporates the invention as regards the rotation shaft and the vehicle support plate.

Looking now at FIG. 1, it is possible to appreciate the jack support leg (1) with its pivoting support foot (28) and the essentially horizontal shaft (9) on which the vehicle support arm (2) rotates. Both the jack support leg (1) and the vehicle support arm (2) are connected by means of the spindle shaft (10) which is received in the support (13), as well as by the nut of the spindle shaft arranged in the jack support leg (1) and not shown here so that the spindle shaft (1) is a means for the vehicle support arm (2) to move;

At the free end of the vehicle support arm (2) we can observe one of the objects of the invention, with the rotation shaft (4) housed in holes (7) in the wings of the vehicle support arm (2), from which its ends protrude, as can be appreciated.

The vehicle support plate (3) shows the vertical side fins (6) which, in the same way, have the ends of the shaft passing through holes (14) in these said fins (6), as shown.

The legs (8) from the vehicle support plate (3) are bent towards the ends of the rotation shaft, so that the shaft becomes controlled by the plate and vice versa.

Figure 2:
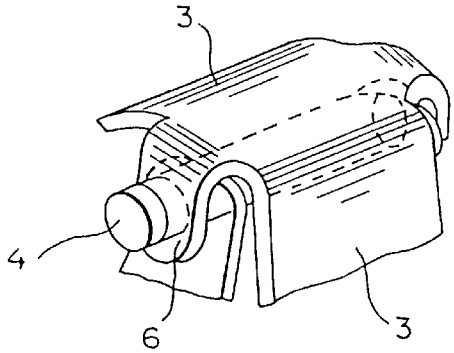
FIG. 2 is a detail concerning a variant of the previous figure.

The variant shown in FIG. 2 represents the solution, according to which the protruding ends of the shaft (4) are riveted in order to carry out this mutual fixing and also in relation to the vehicle support arm (2).

Figure 6:
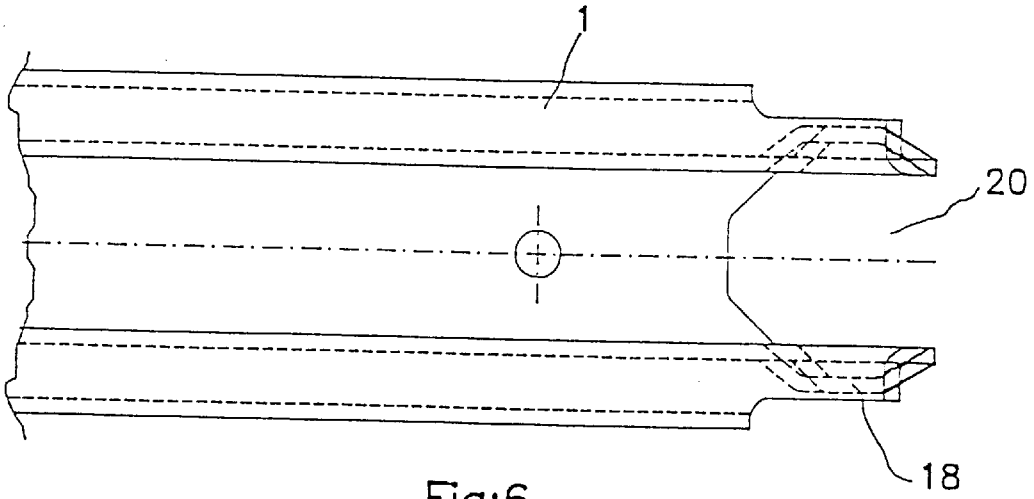

The ends of the jack support leg (1) in FIGS. 3 and 6 are closed, as can be appreciated, and are provided with holes for the pivoting horizontal shaft on and perforated holes (16-18) cut in the ends of their wings. The leg end is not provided with a base and is suitably widened in the mid lower portion (19) of its wings in order to provide a gap in the portion (20) that is sufficient to allow the nut of the spindle shaft to pass through.

Of the sections represented in FIGS. 4 and 5 we can observe how the normal width of the leg between the wings (15) is converted into another geometry (17) with the lower widening (27), which in the same way causes the two end holes to take on an uneven elevation, normal in the upper portion (16) and elbowed in the lower portion (18).

The nut on the spindle shaft, which has a special shape, is housed in the jack support leg (1) in accordance with the position (M) shown in FIG. 3, after which it is adjusted, as shall be described later.

The nut (12) in FIGS. 7, 8 and 9 has a general elongated shape with the axial central screw-threaded cavity (23) to receive the spindle shaft (10) of the jack. In two diametrically opposed positions, the projections (22) with their generally cylindrical shape can be appreciated. Both projections are provided with fins (26) that protrude out in relation to their most outerly plane, as can be appreciated, above the recesses or gaps (21).

In this way, on housing the nut in accordance with the direction of the arrow (M) the cylindrical portion of the projections is received in the area of the holes (16) in the wings, while the protruding nut fins (26) are received in the areas (18) of the said holes, as can be appreciated in FIG. 11.

The nut is situated with the spindle shaft (10), winding handle (11), etc. already assembled, which means that the operation of including the said nut is carried out very simply.

In accordance with FIG. 12, we can see the assembly (28), in which the vehicle support arm (2), made up of a U-shaped section, can be seen. The free ends (33) of the arms are provided with the side projections (31) that provide rounded surface areas (29) with a specific radius and angular distance.

The vehicle support plate (3) is provided in the same way with side projections (32) established in identical curvature, angle and surface conditions as the portions (32) of the vehicle support arm.

The side projections (32) are prolonged into the vertical lugs (30) that run along the exterior of the support projections (31).

In accordance with FIG. 13, we can appreciate the two positions (30, 30') of the lug, and of the way that it is adjusted, by bending or folding, against the lower face of the projection (29). As the surfaces (29) and (32) correspond, the adjustment of the lug (30') allows, as was stated earlier, the movements of the plate (3) to be controlled, the plate to be secured and also for it to turn in relation to the arms.

I claim:

1. Vehicle jack, to lift at a vehicle body work projection, comprising:

a jack support leg (1) and a vehicle support arm (2) that moves in a rocking motion with the jack support leg pivoting around a fixed horizontal shaft (9), the vehicle support arm (2) being movable via a screw-threaded spindle shaft (10) operated by a winding handle (11), with the spindle shaft being supported in a nut (12) fitted into the jack support leg (1) and in a spindle shaft support (13) close to a free end of the vehicle support arm, at which free end is situated a vehicle support plate (3) that receives the projection from the bodywork of the vehicle;

the support plate (3) being rotatable on the vehicle support arm (2) about a rotation axis parallel to the horizontal shaft (9), the support plate (3) being supported on an underside thereof by the support arm (2):

the free ends of the support arm (2) including wings comprising outward projections (31) from an exterior of the wings of the arm, the projections being of a generally circular shape over a certain angle that provides certain support surfaces (29);

the support plate (3) including a set of side projections (32) of a projection shape that corresponds to an arm shape of the arm on which they are supported, the side projections ending externally in vertical lugs (30), which are bent to a position below the projections, whereby the turning of the support plate on the arm is easily locked by the sliding of the surfaces of both parts.

* * * * *